United States Patent [19]

Dezen

[11] Patent Number: 4,467,509

[45] Date of Patent: Aug. 28, 1984

[54] PAINT ROLLER

[76] Inventor: Vittorio Dezen, 5 Riverview Ave., Woodbridge, Ontario, Canada, L4L 2X3

[21] Appl. No.: 422,412

[22] Filed: Sep. 23, 1982

[51] Int. Cl.[3] ..... B21B 13/02

[52] U.S. Cl. ..... 29/116 R; 29/119; 29/123; 29/129; 15/230.11

[58] Field of Search ..... 29/110, 110.5, 116 R, 29/129, 115, 119, 123; 15/230.11

[56] References Cited

U.S. PATENT DOCUMENTS

| | | | |
|---|---|---|---|
| 1,515,823 | 11/1924 | Benoit | 29/123 |
| 3,008,167 | 11/1961 | Pharris et al. | 15/230.11 |
| 3,354,493 | 11/1967 | Pharris | 29/123 |
| 3,357,037 | 12/1967 | Kaplan | 15/230.11 |
| 3,877,123 | 4/1975 | Pharris | 15/230.11 |
| 4,316,301 | 2/1982 | Smith et al. | 15/230.11 |

FOREIGN PATENT DOCUMENTS

| | | | |
|---|---|---|---|
| 619159 | 4/1961 | Canada | 15/230.11 |
| 761772 | 11/1956 | United Kingdom | 15/230.11 |

*Primary Examiner*—Howard N. Goldberg
*Assistant Examiner*—P. W. Echols
*Attorney, Agent, or Firm*—Rogers, Bereskin & Parr

[57] ABSTRACT

A paint roller is described for use with a replaceable paint-applying cover having a rigid hollow cylindrical core. The roller is designed to eliminate or minimize leakage of paint into the interior of the core which in conventional rollers tends to lead to rapid deterioration of both the roller and the cover. The roller includes two end members which fit inside respective ends of the core. One end member has a fixed annular face against which the core abuts while the other is fitted with a separate end cap which can be adjusted axially to tightly grip the core. A snap-fit closure is used to lock the end cap in an adjusted position.

10 Claims, 4 Drawing Figures

PAINT ROLLER

This invention relates generally to paint rollers for use with replaceable paint-applying covers.

Typically, a cover for use with a paint roller comprises a relatively rigid hollow cylindrical core (e.g. in the form of a cardboard tube) covered with a paint applying material. In its simplest form, the roller includes a pair of end caps designed to be pressfitted into the ends of the core and a shaft on which the end caps rotate. The shaft is usually formed from part of a length of relatively large diameter wire which is also shaped to form a handle for the roller. A retaining washer is usually provided on the free outer end of the shaft and a circlip or other locating formation is provided outwardly of the innermost end cap so that the two end caps are located axially on the shaft. The washer can be removed so that the cover and end caps can be slid axially off the shaft. The end caps can then be pried out of the core so that the cover can be cleaned or replaced.

A common problem with this type of paint roller is that the paint flows into the interior of the core when the roller is in use so that the cover becomes saturated with paint both inside and out. This not only makes cleaning of the cover very difficult, but often leads to premature deterioration of the cardboard core of the cover. In any event, such covers often have to be discarded long before their useful life would otherwise be over, because of difficulty in properly cleaning the cover and/or premature deterioration of the core.

A large number of other paint roller constructions have previously been proposed. Examples of such prior proposals are disclosed in Canadian Pat. No. 619,519 and in U.S. Pat. No. 3,877,123. While many of these prior forms of paint roller suffer from their own particular disadvantages, the problem of paint leakage into the interior of the cover appears to be common to all such proposals, as far as applicant is aware.

An object of the present invention is to provide a paint roller which is capable of effectively sealing the interior of the cover against the ingress of paint.

The roller provided by the invention includes a shaft having an inner end and a free outer end and a roller body rotatably carried on the shaft and adapted to fit within the core of a cover and support the cover on the shaft. The roller also includes handle means coupled to the inner end of the shaft and adapted to permit the roller to be manipulated in use for painting. The roller body includes an inner end member rotatably mounted on the shaft adjacent its inner end and located against movement towards that end. The member is adapted to fit within and close the relevant end portion of the core and defines a first annular end face against which an adjacent end face of the core can be urged to inhibit paint flow into the interior of the core in use. At the outer end of the shaft is an assembly which is adapted to seal the core against ingress of paint and which includes an outer end member rotatably located on the shaft adjacent said outer end and adapted to fit closely within an outer end portion of the core while permitting the core to pass thereover when the core is replaced. An end cap is normally coupled to the outer end member but is removable to permit replacement of the cover. The end cap defines a second annular face for abutment with the relevant annular end face of the core and the cap is axially adjustable with respect to the end member to permit the core to be tightly trapped between and sealed against the said first and second annular faces. The assembly also includes locking means releasable from externally of the end cap and adapted to secure the end member and cap in an adjusted axial position.

In summary, the paint roller provided by the invention has a roller body which includes respective end members for engagement in the core of a cover. The outer end member forms part of an assembly which also includes an end cap. The end cap is designed to bear against the outer end of the core of a cover and the cap is axially adjustable so that the core can be tightly trapped and sealed between the annular faces at the ends of the roller body. In this way, it is believed that leakage of paint across the annular ends of the core can be minimized. At the same time, the inner end member and the assembly are designed to inhibit flow of paint directly into the ends of the core. As a result of these design features, it is believed that it should be possible to effectively prevent significant leakage of paint into the interior of the core. However, it is of course to be understood that references herein to "sealing" of the core are not to be interpreted in absolute terms, if only because sealing efficiency will depend to some extent on the judgement of the user in adjusting the end cap with respect to the outer end member.

In order that the invention may be more clearly understood, reference will now be made to the accompanying drawings which illustrate a particular preferred embodiment of the invention by way of example, and in which.

Figure 1:
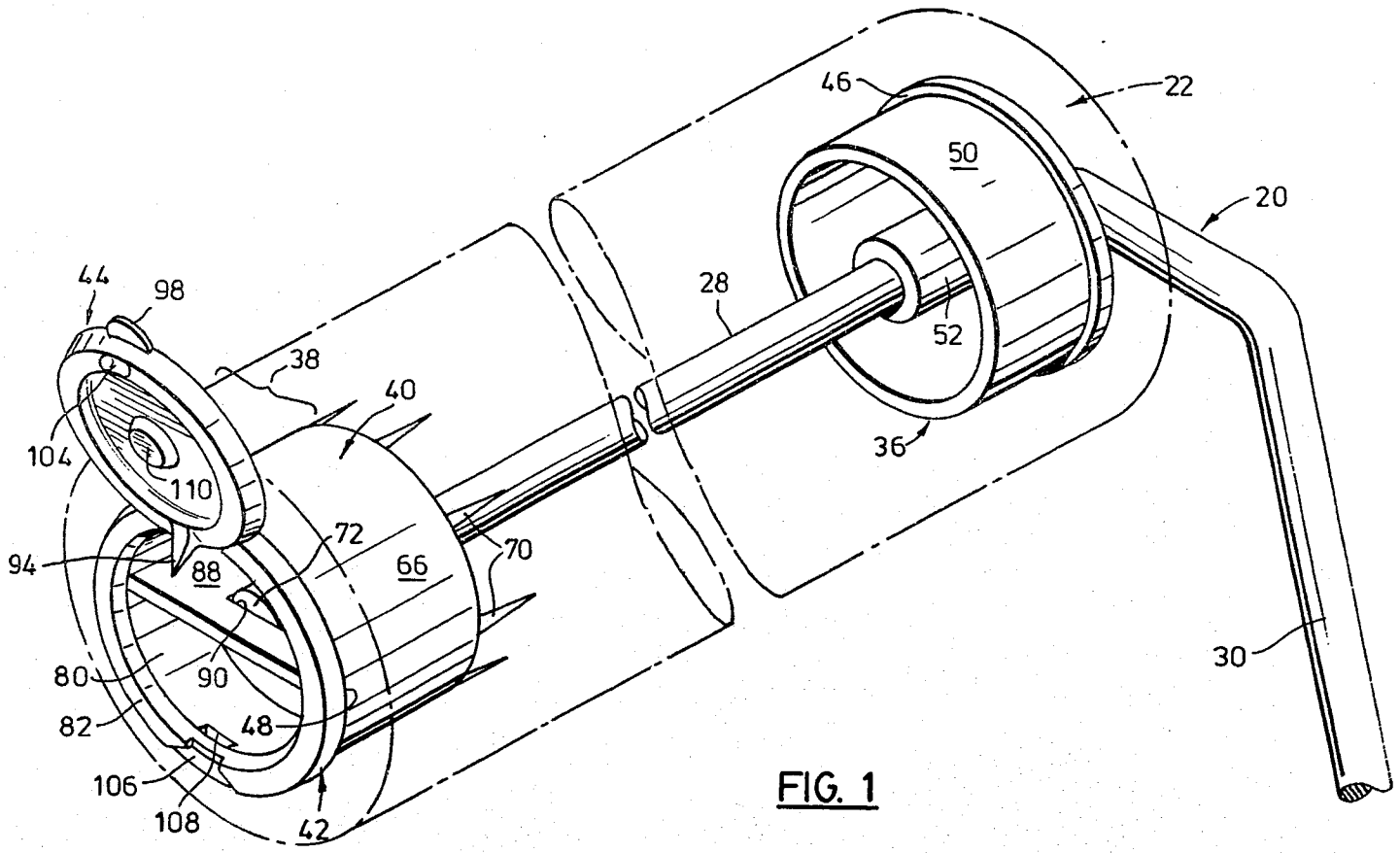
FIG. 1 is a perspective view of the principal components of a paint roller in accordance with the invention for use in association with a cover indicated in ghost outline.

Referring first to FIG. 1, the paint roller itself is generally designated by reference numeral 20 and a painting cover is shown in ghost outline at 22 in place on the roller. The cover is essentially of conventional construction and comprises a relatively rigid hollow cylindrical core which is indicated in ghost outline at 24 in FIG. 3, and a covering 26 of a material suitable for applying paint. Typically, core 24 will be a cardboard tube and the material 26 will be fur-like. However, cover 22 forms no part of the present invention and will not therefore be described in detail.

Figure 3:
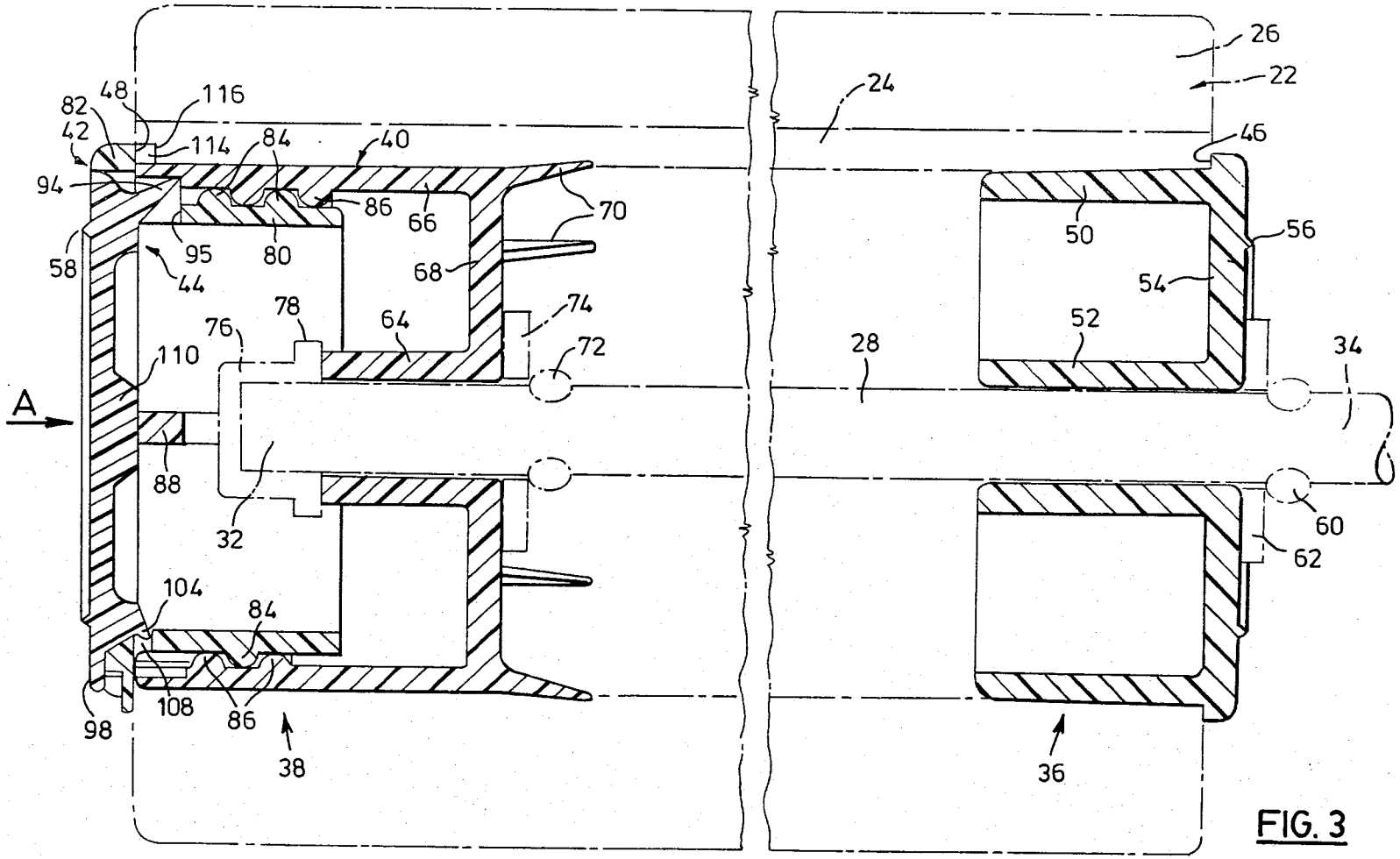
FIG. 3 is a longitudinal sectional view through the assembled components; and, FIG. 4 is an end view in the direction of arrow A in FIG. 3.

Referring back to FIG. 1, the paint roller 20 includes a shaft 28 and a handle, part of which is indicated at 30. The shaft and handle are formed from the same piece of relatively large diameter wire as is conventional in paint rollers. Handle 30 will include a rectilinear portion generally normal to shaft 28 which will be fitted with a hand grip, all as is conventional. In FIG. 3, shaft 28 is shown in ghost outline and it can be seen that the shaft has a free outer end portion denoted 32 and an inner end portion denoted 34.

Rotatably carried on shaft 28 is a two-part roller body adapted to fit within the core 24 of cover 22 and support the cover on shaft 28. One part of the roller body is defined by an inner end member 36 and the other part by an assembly which is generally denoted 38 in FIGS. 1 and 3 and which includes an outer end member 40, an end cap 42 and an end closure 44. As can best be seen in FIG. 3, the core 24 of cover 22 is trapped between respective annular faces 46 and 48 on the inner end member 36 and on the end cap 42. The end cap is adjustable axially of shaft 28 (as will be described) so that core 24 can be tightly trapped between and sealed against the annular faces 46 and 48, inhibiting flow of paint across the opposing end faces of core 24. At the same time, member 36 and assembly 38 are designed to close the ends of core 24 against direct entry of paint. Since the core itself is substantially impervious to paint, it is believed that the interior of the core 24 and also the internal components of the paint roller itself will remain relatively free of paint, increasing the life of both the cover and the roller.

Referring now primarily to FIG. 3, it will be seen that the inner end member 36 is a one-piece plastic moulding and is rotatably mounted on shaft 28 adjacent its inner end 34. Member 36 is adapted to fit within and close the relevant end portion of the core, and at the same time defines the annular face 46 against which the opposing end face of the core can be urged as mentioned previously. Member 36 includes an outer sleeve 50 which is shaped to fit closely within core 24 and which is surrounded at its outer end by the face 46. The member also includes an inner sleeve 52 shaped to fit closely around shaft 28. The two sleeves are connected by an end web 54 which extends generally normal to the axis of shaft 28. An annular projection 56 of generally triangular section protrudes from the outer face of web 54 and acts as a spacer to prevent the end of cover 22 coming into contact with a wall or other surface normal to the surface being painted (e.g. in the corner of a room) when the paint roller is in use. A similar projection 58 is provided on the outer surface of end closure 44 for the same purpose.

End member 36 is located against movement towards the inner end of shaft 28 by a circlip 60 seated in a generally complimentary annular groove in shaft 28. A washer 62 is interposed between the circlip and the end web 54 of member 36.

The outer end member 40 is generally somewhat similar to member 36 in that it includes respective inner and outer sleeves 64 and 66 shaped respectively to fit closely around shaft 28 and to fit closely inside the cover core 24. An annular web 68 extends between the two sleeves. The outer sleeve 66 is essentially of uniform diameter throughout its length so that, while it does fit closely within core 24, the core can be relatively easily slid along the sleeve in fitting a new cover to the roller. Thus, end cap 42 is removable as will be described to permit removal and replacement of cover 22. However, end member 40 does include a number of "fingers" 70 which project outwardly from web 68 and which are splayed outwardly beyond the external surface of sleeve 66 to some extent so as to exert some gripping force on core 24 from the inside. Eight fingers 70 are in fact provided and are disposed in equi-angularly spaced positions about the end member. The "fingers" extend generally axially of shaft 28 so as to present minimal resistance to axial sliding movement of core 24 with respect to member 40, while presenting significant resistance to turning movement.

Member 40 is located against axial movement along shaft 28 by a circlip 72 similar to circlip 60 which locates against the inner end of member 40 with the interposition of a washer 74, and by a spring cap 76 which is fitted to the outer end of shaft 28 and which defines a flange 78 for abutment with the outer end of sleeve 64. It will of course be understood that the length of cap 76 and the position of circlip 72 are carefully selected so as to avoid inhibiting turning of member 40 while restraining the member axially. At the same time, the length of shaft 28 is matched to the overall length of cover 22. Paint roller covers are normally made available in a series of standard sizes and rollers of the form provided by the invention will be made in corresponding sizes. Obviously, the same roller member components will serve for different cover sizes and all that will be necessary will be to provide shafts 28 of different lengths. However, within the broad scope of the invention, it would of course be possible to provide for a single paint roller to accept different length covers, for example, by providing a number of defined annular recesses in shaft 28 to selectively receive the circlip 60, or to provide in place of circlip 60, some other form of retaining element which can be secured to the shaft in any of a number of defined positions.

End cap 42 essentially comprises an inner sleeve 80 dimensioned to fit within the outer sleeve 66 of end member 40, and an annular flange portion 82 which protrudes outwardly beyond sleeve 80 and which defines the annular face 48 referred to above. Sleeve 80 is provided in its external surface with a relatively coarse screw thread indicated at 84, which meshes with a complimentary thread 86 on the inner surface of the outer sleeve 66 of end member 40. These co-operating screw threads allow for axial adjustment of the end cap 42 with respect to the outer end member 40. Thus, it will be understood that, by turning end cap 42, its axial position, and hence the axial position of its annular face 48 is adjusted with respect to the corresponding annular face 46 of the inner end member 36. In this way, the end cap can be adjusted to the optimum position providing the required gripping force on the cover core 24.

Figure 2:
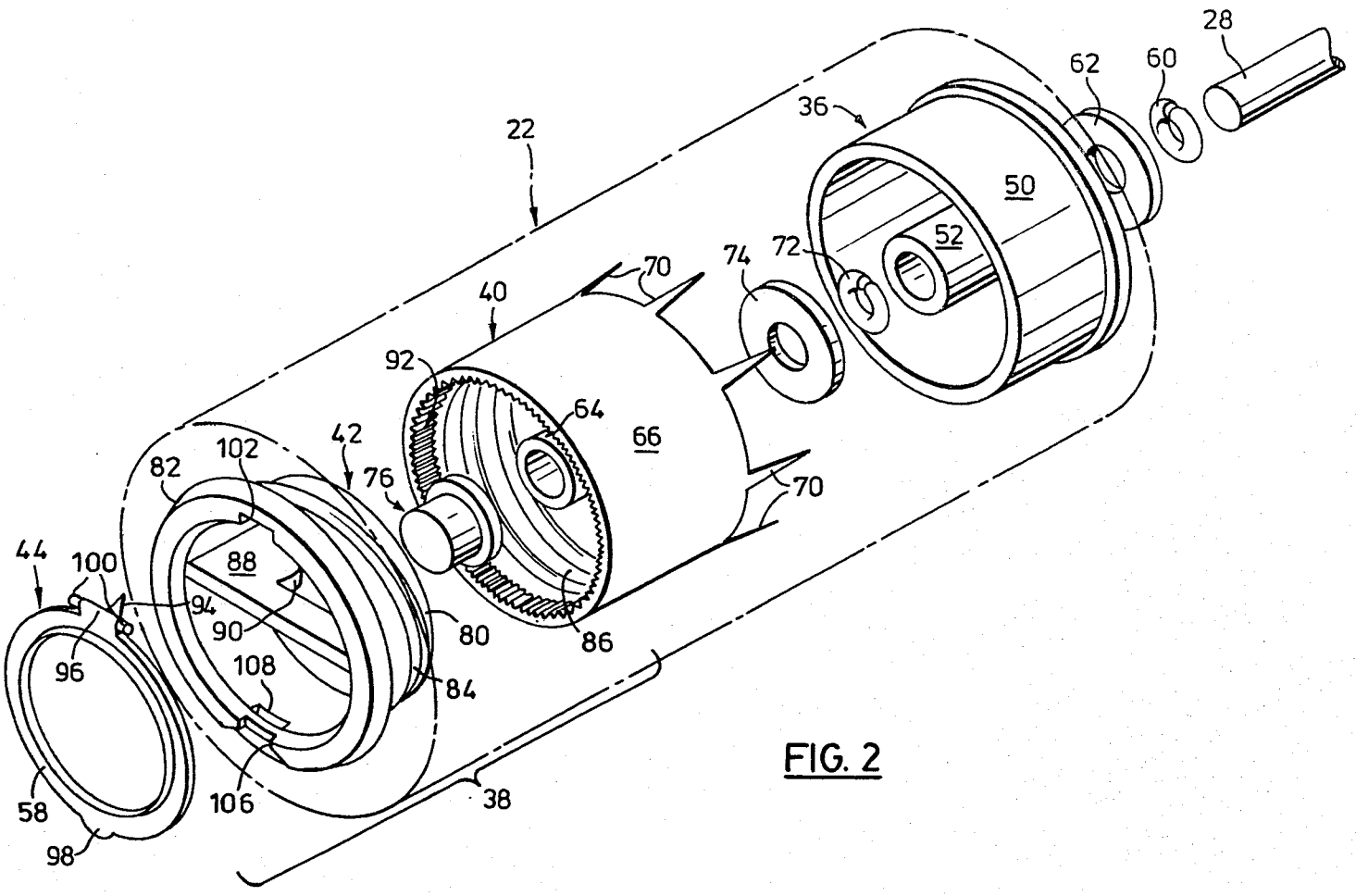
FIG. 2 is an exploded perspective view of the components shown in FIG. 1.

FIG. 2 shows the components of the paint roller in exploded positions, and in perspective. It will be noted that end cap 42 in fact has a transverse internal wall 88 which extends generally diametrally of sleeve 80 and which is recessed at 90 to clear the retainer cap 76 on shaft 28 (see FIG. 3). Wall 88 serves as a finger grip by which the end cap 42 can be turned to vary its axial position. The wall also serves as a support for the end closure 44 of assembly 38 as will be described.

With continued reference to FIG. 2, it will be seen that member 40 is open at its outer end (the left-hand end as shown) and that an annular series of inwardly projecting teeth 92 is provided around the open end of the member. These teeth form part of a locking arrangement for preventing axial displacement of end cap 42 after it has been moved to an adjusted position. Referring back to FIG. 3, it will be seen that the end closure 44 is provided with a projection or tooth 94 which can engage selectively between two of the teeth 92 on member 40. Closure 44 is coupled to end cap 42 so that, when the closure is in its normal operative position, tooth 94 engages teeth 92 through an opening 95 in the sleeve 80 of end cap 42 and effectively locks the end cap to member 40. Tooth 94 can of course engage between any pair of teeth 92 so that end cap 44 and member 40 can be locked together in almost any adjusted position.

Referring back to FIG. 2, it will be seen that closure 44 is of a generally circular shape. In fact, the closure is designed to fit closely within and close the opening in the outer end of cap 42. Suitable sealing surfaces are provided on the co-operating portions of the two components to provide a good seal against ingress of paint.

Suitable sealing elements such as O-rings can be provided although they are believed to be unnecessary.

Closure 44 is pivotally coupled to end cap 42 for movement between a normal closed position (FIG. 3) in which the locking tooth 94 engages the teeth 92 on member 40 and an inoperative, raised position in which the closure has pivoted upwardly to bring tooth 94 clear of teeth 92, for example, as shown in FIG. 1. In this position, end cap 42 can of course be turned with respect to member 40 to adjust the axial position of the end cap as discussed previously.

Referring back to FIG. 2, closure 44 is provided with a pair of diametrally opposed projections 96 and 98. A pair of generally cylindrical "pins" 100 extend from opposite sides of projection 96 and define a pivot axis for closure 44. These projections 100 are snapped into corresponding indentations (not visible) in the sides of a complimentary recess 102 in end cap 42. The other projection 98 serves as a tab by which the closure can be raised from its normal position. Immediately behind the tab is a further projection 104 (FIGS. 1 and 3) which defines a snap fastener for locking closure 44 in its normal closed position. Thus, when the closure is pushed inwardly at its lower end as shown in FIG. 2, projection 104 will snap over a latch formation 106 on end cap 42 and in through a recess 108 where it will hold closure 44 firmly closed.

As can best be seen from FIG. 3, closure 44 is provided with a solid "boss" 110 at its inner side which lies against the internal wall 88 of end cap 42 when the closure is in its closed position. Wall 88 then serves to support the closure and prevent exceptional inward deflection thereof such as might occur if the paint roller were to be misused, for example, to knock in nails as may sometimes occur in practice. For this reason, closure 44 should be made in a tough and impact-resistant plastic material such, for example, as a fifty percent-fifty percent polyethylene polycarbonate mixture. End cap 42 and member 40 are also individual plastic mouldings. These mouldings and end member 36 may be moulded in a polycarbonate material.

Figure 4:
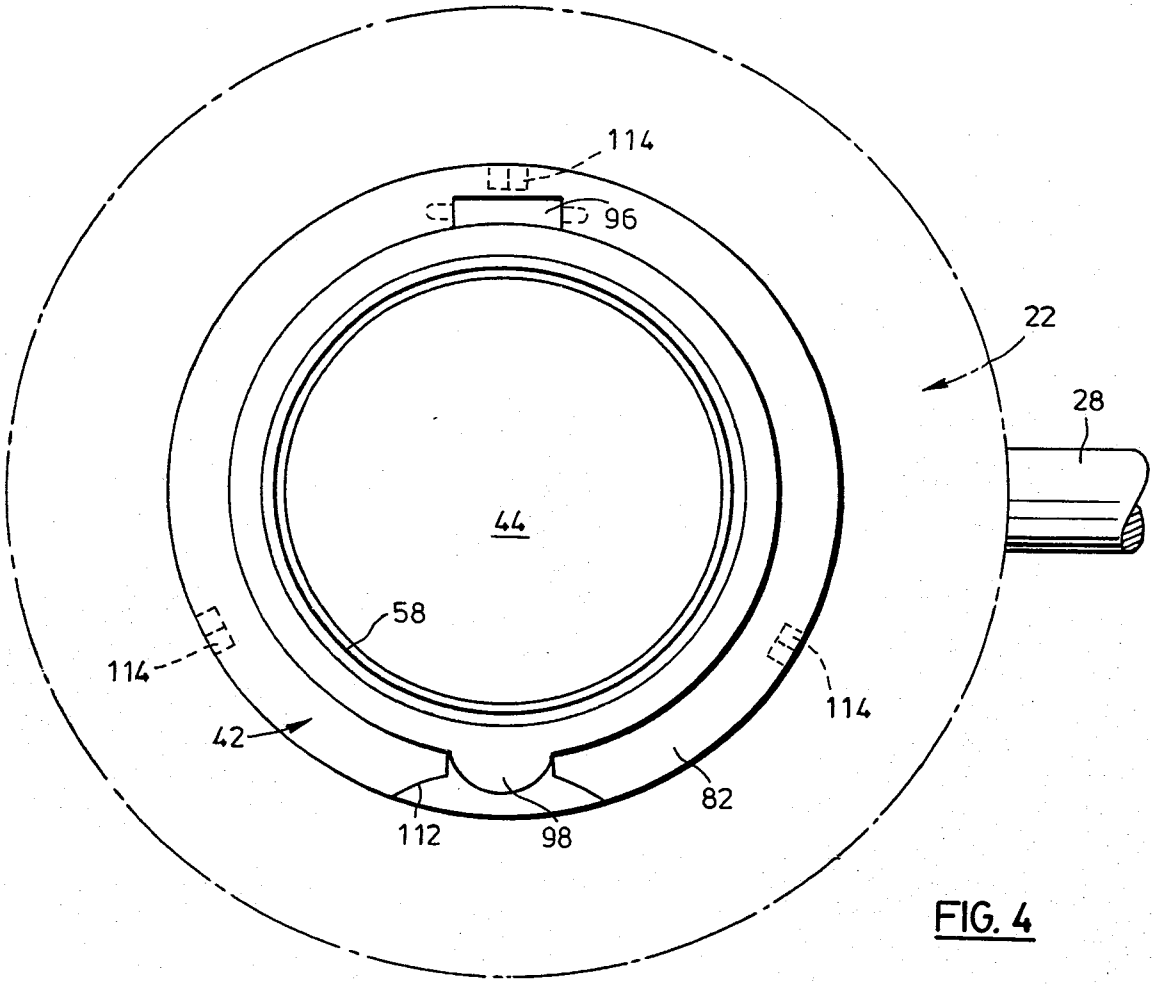

FIG. 4 is an end view generally in the direction of arrow A in FIG. 3 and shows the closure 44 in its closed position. Tab 98 is visible at the bottom in FIG. 4 (although it will of course be understood that closure 44 will not always be oriented in this way in practice) and it will be seen that end cap 42 is formed with a part circular recess 112 behind tab 98. This recess is provided in order to allow a coin to be inserted into the recess behind the tab and used to release the locking projection 104 (FIG. 3).

FIG. 4 also shows in dotted outline three equi-angularly spaced triangular projections 114 on the annular face 48 of end cap 42. One of the formations is also visible in FIG. 3. The formations 114 essentially define short knife edges 116 (FIG. 3) which will indent the relevant end face of core 24 and provide a further restraint against turning of the cover 22 with respect to the end members 36 and 40 in use. The intention is that, when end cap 42 has been tightened to an extent sufficient to grip the core relatively securely, the roller will be grasped by the handle and closure 44 will be hit against a hard surface (such as the floor) to cause the formations 114 to firmly indent the face of the core.

It will of course be appreciated that the preceding description relates to a particular preferred embodiment of the invention only and that many modifications are possible within the broad scope of the invention.

For example, in the preferred embodiment, end cap 42 is coupled to the outer end member 40 by screw threads which allow axial adjustments of the position of end cap 42. While this arrangement is to be preferred, it is to be understood that alternative coupling arrangements allowing for axial adjustment of the end cap may be employed. For example, end cap 42 could simply slide axially within member 40. The two components could be locked in an axially adjusted position by an end closure similar to closure 44 but in which tooth 94 would engage in serrations spaced axially along the inner surface of outer sleeve 66. An alternative locking arrangement would be to provide a solid closed end on end cap 42 and allow shaft 28 to extend through that end and receive some form of retainer carried by the end cap (e.g. a friction fit washer). Alternative locking arrangements such as this could of course also be used with a screw-theaded coupling between the end cap and outer end member as described. In the illustrated embodiment, tooth 94 could frictionally engage the outer end member 40 other than by way of the teeth 92; e.g. the tooth could simply engage a roughened surface on the end member.

Another possible modification would be to interconnect the end members 36 and 40 of the roller body so as to in effect form a composite one-piece roller body. For example, this could be done by making the two components as one or by interconnecting the end members, for example, by rods push-fitted into recesses in respective members.

Finally, it should be noted that, while reference has been confined to "paint" rollers, the invention is equally applicable to rollers for other purposes, e.g. for applying other liquids or rollers intended for applications in which a smoothing or flattening action is required. The term "paint roller" has been adopted merely for convenience of description.

We claim:

1. A paint roller for use with a replaceable paint-applying cover which includes a relatively rigid hollow cylindrical core, the roller comprising: a shaft having an inner end and a free outer end; a roller body rotatably carried on said shaft for fitting within said core and support the cover on the shaft; and handle means coupled to said inner end of the shaft for permitting the roller to be manipulated in use for painting;

said roller body comprising:

an inner end member rotatably mounted on the shaft adjacent its said inner end and located against movement towards said end, said member for fitting within and closing the relevant end portion of the core and defining a first annular end face against which an adjacent end face of the core can be urged to inhibit paint flow into the interior of the core in use; and, an assembly at said outer end of the shaft for sealing said core against the ingress of paint, said assembly comprising:

an outer end member rotatably located on said shaft adjacent an outer end thereof for fitting closely within an outer end portion of said core while permitting the core to pass thereover when the cover is replaced;

an end cap which is normally coupled to said outer end member but which is removable to permit replacement of the cover, said end cap defining a second annular face for abutment with the relevant annular end face of the core and being axially adjustable with respect to said outer end member to permit the core to be tightly trapped between and sealed against said first and second annular faces; and, locking means releasable from externally of said end cap and for securing said outer end member and said end cap in relative adjusted axial adjusted positions.

2. A paint roller as claimed in claim 1, wherein said end cap and said outer end member define co-operating screw threads arranged to permit said axial adjustment of the end cap with respect to said end member by turning the end cap.

3. A paint roller as claimed in claim 2, wherein said end cap has an open outer end permitting access to the interior of said assembly, and wherein said assembly further comprises a removable closure normally closing said open end against ingress of paint.

4. A paint roller as claimed in claim 3, wherein said closure is pivotally coupled to said end cap for movement between an open position and a closed position and is normally retained in said closed position by snap-fastening means on said closure and end cap.

5. A paint roller as claimed in claim 3, wherein said end cap includes a transverse internal wall which is accessible after removal of said closure and by which the cap can be axially displaced, said wall and closure cooperating when the closure is in its closed position so that the wall supports the closure against inward deflection.

6. A paint roller as claimed in claim 4, wherein said locking means comprises a tooth carried by said closure for frictionally engaging said outer end member and for preventing rotation of the member with respect to the end cap when the closure is in its closed position, said tooth being arranged to move clear of the end member when the closure is opened.

7. A paint roller as claimed in claim 6, wherein said outer end member includes an outer annular sleeve formed with a continuous annular series of inwardly projecting teeth positioned for co-operation with said tooth of the closure, whereby said end cap and outer end member can be locked in substantially any adjusted axial position by engagement of the closure tooth between an appropriate pair of said continuous series of teeth.

8. A paint roller as claimed in claim 1, wherein said outer end member comprises inner and outer cylindrical sleeves, said inner sleeve closely receiving said shaft and said outer sleeve closely fitting within said core, and wherein said outer sleeve is provided at an inner end thereof with a series of outwardly splayed formations for gripping said core and restrain the core against turning with respect to the member.

9. A paint roller as claimed in claim 1, wherein at least one of said annular faces is provided with a series of projections shaped to indent the relevant end face of said core and assist in inhibiting turning movement of the cover with respect to said face.

10. A paint roller as claimed in claim 1, wherein each of said inner end member and said assembly has a substantially flat outer face interrupted by an annular projection for spacing the relevant end of a cover on said roller from a surface contacted by said projection.

* * * * *